US011788168B2

(12) United States Patent
Sieron et al.

(10) Patent No.: US 11,788,168 B2
(45) Date of Patent: Oct. 17, 2023

(54) ELECTRICAL STEEL STRIP THAT CAN BE BUT DOESN'T HAVE TO BE REANNEALED

(71) Applicants: ThyssenKrupp Steel Europe AG, Duisburg (DE); thyssenkrupp AG, Essen (DE)

(72) Inventors: Sebastian Sieron, Essen (DE); Philipp Szary, Witten (DE); Olaf Fischer, Bochum (DE); Abdullah Kahveci, Bochum (DE); Karl Telger, Coesfeld (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 151 days.

(21) Appl. No.: 16/963,728

(22) PCT Filed: Jan. 23, 2019

(86) PCT No.: PCT/EP2019/051614
§ 371 (c)(1),
(2) Date: Jul. 21, 2020

(87) PCT Pub. No.: WO2019/149593
PCT Pub. Date: Aug. 8, 2019

(65) Prior Publication Data

US 2021/0079493 A1 Mar. 18, 2021

(30) Foreign Application Priority Data

Feb. 2, 2018 (DE) ..... 102018201622.4

(51) Int. Cl.

| | |
|---|---|
| ***C22C 38/04*** | (2006.01) |
| ***C21D 9/52*** | (2006.01) |
| ***C21D 6/00*** | (2006.01) |
| ***C21D 8/12*** | (2006.01) |
| ***C22C 38/00*** | (2006.01) |
| ***C22C 38/02*** | (2006.01) |
| ***C22C 38/06*** | (2006.01) |
| ***C22C 38/14*** | (2006.01) |
| ***H01F 1/147*** | (2006.01) |
| ***C21D 9/46*** | (2006.01) |

(52) U.S. Cl.
CPC ..... *C21D 9/52* (2013.01); *C21D 6/005* (2013.01); *C21D 6/008* (2013.01); *C21D 8/1222* (2013.01); *C21D 8/1233* (2013.01); *C21D 8/1261* (2013.01); *C21D 9/46* (2013.01); *C22C 38/001* (2013.01); *C22C 38/004* (2013.01); *C22C 38/02* (2013.01); *C22C 38/04* (2013.01); *C22C 38/06* (2013.01); *C22C 38/14* (2013.01); *H01F 1/147* (2013.01); *C21D 2201/05* (2013.01)

(58) Field of Classification Search
CPC ..... C22C 38/06
See application file for complete search history.

(56) References Cited

U.S. PATENT DOCUMENTS

| | | | | |
|---|---|---|---|---|
| 5,803,988 | A | 9/1998 | Bae et al. | |
| 6,139,650 | A | 10/2000 | Oda et al. | |
| 11,041,222 | B2 * | 6/2021 | Fischer | C22C 38/004 |
| 2014/0083573 | A1 | 3/2014 | Dorner et al. | |
| 2015/0318093 | A1 | 11/2015 | Hill et al. | |
| 2016/0203897 | A1 | 7/2016 | Dorner et al. | |
| 2017/0044641 | A1 | 2/2017 | Fortunati | |
| 2020/0010918 | A1 * | 1/2020 | Zaizen | C22C 38/16 |
| 2021/0062307 | A1 * | 3/2021 | Sieron | C21D 8/0205 |

FOREIGN PATENT DOCUMENTS

| | | | | |
|---|---|---|---|---|
| CN | 1305019 | A | 7/2001 | |
| CN | 101343683 | A | 1/2009 | |
| CN | 102382963 | A | 3/2012 | |
| CN | 104141092 | A | 11/2014 | |
| CN | 105950960 | A | 9/2016 | |
| CN | 107002160 | A | 8/2017 | |
| CN | 107245644 | A | 10/2017 | |
| DE | 19681215 | | 4/1998 | |
| EP | 0866144 | B1 | 11/2005 | |
| EP | 2612942 | A1 | 7/2013 | |
| EP | 2840157 | A1 | 2/2015 | |
| IN | 3138MUM2011 | A | 5/2014 | |
| JP | H07228953 | A | 8/1995 | |
| JP | H11222653 | A | 8/1999 | |
| JP | 2005200755 | A | 7/2005 | |
| JP | 2011162821 | A | 8/2011 | |
| WO | 0065103 | A2 | 11/2000 | |
| WO | WO-2018147044 | A1 * | 8/2018 | C21D 1/30 |

OTHER PUBLICATIONS

International Search Report for International Application No. PCT/EP2019/051614 dated Feb. 28, 2019 with English translation.
Chinese Office Action and Search Report for CN Application No. 201980011468.1 dated Aug. 2, 2021.
2nd Chinese Office Action for CN Application No. 201980011468.1 dated Jan. 18, 2022.
DIN EN 10351 : May 2011—Chemical analysis of ferrous materials—Inductively coupled plasma optical emission spectrometric analysis of unalloyed and low alloyed steels—Determination of Mn, P, Cu, Ni, Cr, Mo, V, Co, Al (total) and Sn.
DIN EN 60404-13 : May 2008—Magnetic materials—Part 13: Methods of measurement of resistivity, density and stacking factor of electrical steel strip and sheet.

(Continued)

*Primary Examiner* — Jophy S. Koshy
(74) *Attorney, Agent, or Firm* — RMCK Law Group PLC

(57) ABSTRACT

The present disclosure provides a non-grain-oriented electrical steel strip which can be used in electric machines such as electric motors and generators. In examples, the non-grain oriented electrical steel strip can be used as a stator having good magnetic properties and as a rotor having good mechanical properties. A reference heat treatment performed subsequent to an initial final heat treatment makes it possible to obtain improved magnetic properties.

9 Claims, No Drawings

(56) References Cited

OTHER PUBLICATIONS

DIN EN 60404-2: Jan. 2009—Magnetic materials—Part 2: Methods of measurement of the magnetic properties of electrical steel strip and sheet by means of an Epstein frame.
DIN EN ISO 6892-1: Feb. 2017—Metallic materials—Tensile testing—Part 1: Method of test at room temperature.

* cited by examiner

ELECTRICAL STEEL STRIP THAT CAN BE BUT DOESN'T HAVE TO BE REANNEALED

CROSS-REFERENCE TO RELATED APPLICATIONS

This application is a 371 U.S. National Stage of International Application No. PCT/EP2019/051614, filed Jan. 23, 2019. The disclosure of the above application is incorporated herein by reference in its entirety.

TECHNICAL FIELD

The invention relates to a non-grain-oriented electrical steel strip or sheet, in particular for electrical applications, an electrical component produced from such an electrical steel strip or sheet, a process for producing an electrical steel strip or sheet and the use of such an electrical steel strip or sheet in components for electrical applications.

Non-grain-oriented electrical steel strips or sheets, also referred to in technical language as "NO electrical steel strip or sheet" or in English as "NGO electrical steel" ("NGO"=Non Grain Oriented), are used for reinforcing the magnetic flux of rotating electric machines. Typical uses of such steel sheets are electric motors and generators, in these especially in the stator or in the rotor.

The non-grain-oriented electrical steel strips used in the stator and in the rotor of a high-frequency electric machine, in particular a motor or generator, preferably have different mechanical and magnetic properties. The rotor packet of an electric machine is preferably produced from a material which has markedly improved mechanical properties, while the stator should have improved magnetic properties. The improvement in the magnetic properties in a material generally has an adverse effect on the mechanical properties of the material, and vice versa. For this reason, a material which represents a compromise between mechanical and magnetic properties is selected either for rotor or stator in the production of electric machines, or otherwise two different types of electrical steel strip have to be used for rotor and stator.

TECHNICAL BACKGROUND

EP 2 612 942 discloses a non-grain-oriented electrical steel strip or sheet composed of a sheet which contains, apart from iron and unavoidable impurities from 1.0 to 4.5% by weight of Si, up to 2.0% by weight of Al, up to 1.0% by weight of Mn, up to 0.01% by weight of C, up to 0.01% by weight of N, up to 0.012% by weight of S, from 0.1 to 0.5% by weight of Ti and from 0.1 to 0.3% by weight of P, where the ratio of content of Ti/content of P, in each case in % by weight, is such that 1.0 content of Ti/content of P≤2.0. The non-grain-oriented electrical steel strip or sheet and components for electrical applications made of such a sheet or strip display good magnetic properties. The NO electrical steel strip or sheet according to EP 2 612 942 is produced from cold rolling a hot-rolled strip consisting of a steel having the abovementioned composition to give a cold-rolled strip and subsequently subjecting this cold-rolled strip to a final heat treatment.

EP 2 840 157 discloses a non-grain-oriented electrical steel strip or sheet, in particular for electrical applications, produced from a steel which contains, apart from iron and unavoidable impurities, from 2.0 to 4.5% by weight of Si, from 0.03 to 0.3% by weight of Si, up to 2.0% by weight of Al, up to 1.0% by weight of Mn, up to 0.01% by weight of C, up to 0.01% by weight of N, up to 0.001% by weight of S and up to 0.015% by weight of P, with ternary Fe—Si—Zr precipitates being present in the microstructure of the electrical steel strip or sheet. EP 2 840 157 also discloses a process for producing such electric steel strips and sheets, which process includes a final heat treatment.

WO 00/65103 A2 discloses a process for producing non-grain-oriented electrical steel sheet, in which a steel precursor material containing less than 0.06% by weight of C, from 0.03 to 2.5% by weight of Si, less than 0.4% by weight of Al, from 0.05 to 1% by weight of Mn and less than 0.02% by weight of S is hot rolled to give a hot-rolled strip having a thickness of less than 3.5 mm, subsequently pickled and after pickling rolled to give a cold-rolled strip having a thickness of from 0.2 to 1 mm.

It is therefore an object of the invention to provide a non-grain-oriented electrical steel strip or sheet which can be used in electric machines, in particular electric motors or generators, both as rotor having improved mechanical properties and as stator having improved magnetic properties, with these different, mutually contradictory properties easily being able to be converted into one another.

This object is achieved by a non-grain-oriented electrical steel strip or sheet containing, apart from iron and unavoidable impurities (figures in each case in % by weight), up to 0.0040 of C, from 0.1500 to 0.3000 of Mn, from 2.300 to 2.700 of Si, from 0.3000 to 0.8000 of Al, up to 0.0400 of P, up to 0.0035 of S, up to 0.0070 of N and up to 0.0070 of Ti, where the ratio of magnetic loss $P_{1.0/50}$ in the finally heat treated state to the magnetic loss $P_{1.0/50}$ in the reference heat treated state is at least 1.50.

For the purposes of the present invention, "reference heat treatment" of the non-grain-oriented electrical steel strip of the invention is the heat treatment of the non-grain-oriented electrical steel strip or sheet according to the invention at the end of the production process, corresponding to the optional step (D) of the process described below, at a temperature of from 600 to 1000° C. The "reference heat treated state" is thus the state of the non-grain-oriented electrical steel strip or sheet according to the invention after heat treatment at a temperature of from 600 to 1000° C. Correspondingly, the "finally heat treated state" is the state of the non-grain-oriented electrical steel strip according to the invention before the heat treatment at a temperature of from 600 to 1000° C., corresponding to the optional step (D) of the process of the invention.

The objects are additionally achieved by a process for producing the non-grain-oriented electrical steel strip or sheet of the invention, by a component for electrical applications produced from such an electrical steel strip and by the use of the electrical steel strip in components for electrical applications.

The non-grain-oriented electrical steel strip of the invention is made of a steel which contains, apart from iron and unavoidable impurities (figures in each case in % by weight)

up to 0.0040 of C,
from 0.1500 to 0.3000 of Mn,
from 2.300 to 2.700 of Si,
from 0.3000 to 0.8000 of Al,
up to 0.0400 of P,
up to 0.0035 of S,
up to 0.0070 of N and
up to 0.0070 of Ti.

The non-grain-oriented electrical steel strip of the invention is preferably produced from a steel containing, apart from iron and unavoidable impurities (figures in each case in % by weight)
from 0.001 to 0.0035 of C,
from 0.15 to 0.25 of Mn,
from 2.35 to 2.7 of Si,
from 0.33 to 0.75 of Al,
up to 0.030 of P, more preferably at least 0.005% by weight of P,
from 0.0005 to 0.0015 of S,
from 0.002 to 0.004 of N and
from 0.001 to 0.004 of Ti.

The amounts of the individual elements present in the steel which is preferably used according to the invention are determined by methods known to a person skilled in the art, for example by chemical analysis in accordance with DIN EN 10351: 2011-05 "Chemical analysis of ferrous materials—inductively coupled plasma optical emission spectrometric analysis of unalloyed and low-alloyed steels".

The inventors of the present invention have discovered that it is possible to provide a non-grain-oriented electrical steel strip which can be used in electric machines, in particular electric motors and generators, both as stator having good magnetic properties and as rotor having good mechanical properties, where the change in the properties is effected by means of a reference heat treatment of the material obtained after the final heat treatment. According to the invention, the reference heat treatment makes it possible to obtain a non-grain-oriented electrical steel strip which has improved magnetic properties compared to the finally heat treated material; in particular, the magnetic losses P at various polarizations and/or frequencies are significantly reduced. This property of the material of the invention is expressed by the ratio of magnetic loss $P_{1.0/50}$ in the finally heat treated state to magnetic loss $P_{1.0/50}$ in the reference heat treated state being at least 1.30, i.e. the magnetic loss $P_{1.0/50}$ in the reference heat treated state being significantly reduced. On the other hand, the grain-oriented electrical steel strip of the invention in the finally heat treated state has improved mechanical properties compared to the reference heat treated state.

According to the invention, the non-grain-oriented electrical steel strip or sheet of the invention has good mechanical properties in the finally heat treated state and good magnetic properties in the reference heat treated state. In this way, a significant efficiency increase of electric machines is achieved using the non-grain-oriented electrical steel strip of the invention compared to a uniform material for rotor and stator, since it is possible to provide for each of rotor and stator a material which has either improved mechanical properties or improved magnetic properties.

In a preferred embodiment, the present invention provides the non-grain-oriented electrical steel strip or sheet according to the invention which in the finally heat treated state has very small, specific grain sizes, for example a grain size here of from 50 to 130 μm, preferably from 70 to 100 μm. The present invention therefore preferably provides the non-grain-oriented electrical steel strip according to the invention which in the finally heat treated state has a grain size of from 50 to 130 μm, preferably from 70 to 100 μm. The grain size can be determined by all methods known to a person skilled in the art, for example by means of a microstructural analysis by means of optical microscopy in accordance with ASTM E112 "Standard Test Methods for Determining Average Grain Size".

The non-grain-oriented electrical steel strip or sheet of the invention has an advantageous ratio of magnetic losses P in the finally heat treated state to magnetic losses P in the reference heat treated state. For the purposes of the invention, the "finally heat treated" state including a skin pass (rolling step) also encompasses a "semifinished" state. For the purposes of the present invention, the expression $P_{1.0/50}$ refers to the magnetic loss P at a polarization of 1.0 T and a frequency of 50 Hz. The magnetic losses P can for the purposes of the invention be determined, for example, by means of an Epstein frame, in particular in accordance with DIN EN 60404-2:2009-01: Magnetic materials—Part 2: Methods of measurement of the magnetic properties of electrical steel strip and sheet by means of an Epstein frame". Here, appropriate electrical steel sheets are measured in the longitudinal direction (L), transverse direction (Q) or in a combination of the two (mixed direction (M)). For the purposes of the present invention, the values are in each case reported for the mixed direction (M).

In the non-grain-oriented electrical steel strip or sheet of the invention, the ratio of magnetic loss $P_{1.0/50}$ in the finally heat treated state to magnetic loss $P_{1.0/50}$ in the reference heat treated state is at least 1.30, preferably at least 1.32, particularly preferably at least 1.60. An upper limit for this ratio is, for example, 2.50.

In the non-grain-oriented electrical steel strip or sheet of the invention, the ratio of magnetic loss $P_{1.5/50}$ in the finally heat treated state to magnetic loss $P_{1.5/50}$ in the reference heat treated state is preferably at least 1.10, particularly preferably at least 1.20, very particularly preferably at least 1.60. An upper limit for this ratio is, for example, 2.0.

Further preference is given to the ratio of magnetic loss $P_{1.0/400}$ in the finally heat treated state to magnetic loss $P_{1.0/400}$ in the reference heat treated state in the non-grain-oriented electrical steel strip or sheet of the invention being at least 1.10, particularly preferably at least 1.15, very particularly preferably at least 1.20. An upper limit for this ratio is, for example, 1.60.

These ratios according to the invention of the magnetic losses in various polarizations and/or frequencies clearly show that the magnetic properties in the non-grain-oriented electrical steel strip or sheet of the invention are significantly improved by the reference heat treatment.

In the non-grain-oriented electrical steel strip or sheet of the invention, the ratio of yield point $Rp_{0.2}$ in the finally heat treated state to yield point $Rp_{0.2}$ in the reference heat treated state is preferably at least 1.05, particularly preferably at least 1.10, very particularly preferably at least 1.15. An upper limit for this ratio is, for example, 1.40.

In the non-grain-oriented electrical steel strip or sheet of the invention, the ratio of tensile strength $R_m$ in the finally heat treated state to tensile strength $R_m$ in the reference heat treated state is preferably at least 1.01, particularly preferably at least 1.05. An upper limit for this ratio is, for example, 1.30.

In the non-grain-oriented electrical steel strip or sheet of the invention, the ratio of polarization $J_{2500/50}$ in the finally heat treated state to polarization $J_{2500/50}$ in the reference heat treated state is preferably at least 1.01. An upper limit for this ratio is, for example, 1.10.

For the purposes of the present invention, $J_{2500/50}$ refers to the polarization at a field strength of 2500 A/m and a frequency of 50 Hz. Methods for determining polarization and field strength are known to a person skilled in the art, for example by means of an Epstein frame for determining the polarization, in particular in accordance with DIN EN 60404-2:2009-01: "Magnetic materials—Part 2: Methods of measurement of the magnetic properties of electrical steel strip and sheet by means of an Epstein frame".

Compared to grain-oriented electrical steel strips according to the prior art, the non-grain-oriented electrical steel strip or sheet of the invention has an advantageous, relatively high specific electrical resistance. Methods for determining the specific electrical resistance are known per se to a person skilled in the art, for example with the aid of a four-point measurement in accordance with DIN EN 60404-13: 2008-05 "Magnetic materials—Part 13: Methods of measurement of density, resistivity and stacking factor of electrical steel sheet and strip".

In general, the non-grain-oriented electrical steel strip or sheet of the invention can be present in all thicknesses which are suitable for electrical applications. According to the invention, the electrical steel strip or sheet preferably has particularly low thicknesses since the magnetic losses are lower at these low thicknesses than at greater thicknesses. The electrical steel strip or sheet of the invention preferably has a thickness of from 0.26 to 0.38 mm, in each case with a deviation of up to 8%.

The non-grain-oriented electrical steel strip or sheet of the invention preferably has a tensile strength $R_m$ of 400 to 600 N/mm$^2$, with the non-grain-oriented electrical steel strip or sheet of the invention preferably having a tensile strength $R_m$ of from 480 to 600 N/mm$^2$ in the finally heat treated state and preferably having a tensile strength Rm of from 400 to 520 N/mm$^2$ in the reference heat treated state. Testing is carried out in the longitudinal direction of the material, i.e. in the rolling direction of the electrical steel strip. This is generally the poorer direction for the tensile strength because of possible anisotropy present in the material. The tensile strength is, according to the invention, determined by methods known to a person skilled in the art, for example the tensile test in accordance with DIN EN ISO 6892-1: 2017-02 "Metallic materials—Tensile testing—Part 1: Method of test at room temperature".

The non-grain-oriented electrical steel strip or sheet of the invention preferably has a yield point $Rp_{0.2}$ of from 300 to 440 N/mm$^2$, with the non-grain-oriented electrical steel strip or sheet of the invention preferably having a yield point $Rp_{0.2}$ of from 400 to 440 N/mm$^2$ in the finally heat treated state and a yield point $Rp_{0.2}$ of from 300 to 400 N/mm$^2$ in the reference heat treated state. The yield point is determined according to the invention by methods known to a person skilled in the art, for example the tensile test in accordance with DIN EN ISO 6892-1: 2017-02 "Metallic materials—Tensile testing—Part 1: Method of test at room temperature".

The non-grain-oriented electrical steel strip of the invention is characterized in that it has particular advantageous mechanical properties in the finally heat treated state and can be converted by a reference heat treatment into a material which has particularly advantageous magnetic properties. This material can thus be used in electric machines, in particular electric motors or generators, both as stator and also as rotor, which in turn gives the abovementioned advantages.

The present invention also provides a process for producing a non-grain-oriented electrical steel strip or sheet of the invention, which comprises at least the following process steps:

(A) Provision of a hot-rolled strip containing, apart from iron and unavoidable impurities (figures in each case in % by weight)
up to 0.0040 of C,
from 0.1500 to 0.3000 of Mn,
from 2.300 to 2.700 of Si,
from 0.3000 to 0.8000 of Al,
up to 0.0400 of P,
up to 0.0035 of S,
up to 0.0070 of N and
up to 0.0070 of Ti, (B) Cold rolling of the hot-rolled strip to give a cold-rolled strip, and (C) Heat treatment of the cold-rolled strip from step (B) to give a non-grain-oriented electrical steel strip.

For this purpose, a hot-rolled strip having the composition indicated above for the non-grain-oriented electrical steel strip or sheet of the invention is firstly provided, and this is subsequently cold rolled and subjected as cold-rolled strip to a heat treatment (step (C), also referred to as final heat treatment). Step (C) of the process of the invention results in a non-grain-oriented electrical steel strip which is ready for use in electric machines and displays a stress-free state combined with above-average good mechanical properties compared to types of non-grain-oriented electrical steel strip according to the prior art. Due to the likewise achieved fine grain microstructure, possible damage caused by a parting process such as cutting, stamping or laser cutting is less than in the case of types of non-grain-oriented electrical steel strip according to the prior art.

According to the invention, the non-grain-oriented electrical steel strip obtained after step (C) of the process of the invention can be subjected to a further heat treatment step (D), referred to as the "reference heat treatment". As a result, any damage arising at the parting edges in the parting process is repaired and grain growth is promoted in the core of the material. This results in the material which has been treated in this way having excellent magnetic properties.

The present invention therefore preferably provides the process of the invention, wherein the following step (D):

(D) Reference heat treatment of the non-grain-oriented electrical steel strip from step (C) at a temperature of from 600 to 1000° C.

is carried out after step (C).

The individual steps of the process of the invention are described in detail below.

Step (A) of the process of the invention comprises provision of a hot-rolled strip containing, apart from iron and unavoidable impurities (figures in each case in % by weight) up to 0.0040 of C, from 0.1500 to 0.3000 of Mn, from 2.300 to 2.700 of Si, from 0.3000 to 0.8000 of Al, up to 0.0400 of P, up to 0.0035 of S, up to 0.0070 of N and up to 0.0070 of Ti. Preferred amounts are indicated further above.

The production of the hot-rolled strip provided according to the invention can be carried out largely conventionally. For this purpose, a steel melt having a composition corresponding to that prescribed by the invention can firstly be melted and cast to give a precursor material, which in the case of conventional manufacture can be a slab or thin slab.

The precursor material produced in this way can subsequently be brought to a precursor material temperature of from 1020 to 1300° C. For this purpose, the precursor material is reheated if necessary or maintained at the respective target temperature by utilization of the heat of the casting.

The precursor material which has been heated in this way can then be hot rolled to give a hot-rolled strip having a thickness which is typically from 1.5 to 4 mm, in particular from 1.5 to 3 mm. Hot rolling commences in a manner known per se at an initial hot rolling temperature in the finishing train of greater than 900° C., for example from 1000 to 1150° C., and ends with a final hot rolling temperature of less than 900° C., preferably from 700 to 920° C., in particular from 780 to 850° C.

The hot-rolled strip obtained can subsequently be cooled to a reel temperature and reeled up to give a coil. The reel temperature is ideally selected so that problems are avoided in the cold rolling subsequently carried out. In practice, the reel temperature is for this purpose not more than, for example, 700° C.

After hot rolling or before cold rolling, a heat treatment can optionally be carried out in the reeled-up state. This heat treatment step is carried out at, for example, a temperature of from 600 to 900° C.

A cleaning step by means of pickling can optionally be carried out before the cold rolling in step (B) of the process of the invention. Appropriate methods are known per se to a person skilled in the art.

Step (B) of the process of the invention comprises cold rolling of the hot-rolled strip to give a cold-rolled strip.

The hot-rolled strip provided is cold rolled to give a cold-rolled strip having a thickness which typically corresponds to the thickness of the electrical steel strip or sheet of the invention, i.e. preferably from 0.26 to 0.38 mm, in each case with a deviation of up to 8%. Processes and procedures for cold rolling are known per se to a person skilled in the art. According to the invention, the decrease in thickness of the material in the first pass is preferably not more than 35%. Furthermore, the decrease in the material in the last pass is preferably not more than 20%.

Step (C) of the process of the invention comprises heat treatment of the cold-rolled strip from step (B) in order to give a non-grain-oriented electrical steel strip.

Step (C) of the process of the invention is preferably carried out as a continuous process. Appropriate apparatuses, i.e. furnaces, in which the cold-rolled strip from step (B) of the process of the invention can be continuously heat treated are known per se to a person skilled in the art. The heat treatment in step (C) of the process of the invention is preferably carried out at a temperature of from 750 to 1000° C., particularly preferably from 750 to 950° C. The process speed at the temperature indicated is preferably from 60 to 100 m/min.

After the heat treatment carried out in step (C) of the process of the invention, the non-grain-oriented electrical steel strip obtained is preferably cooled to ambient temperature and can, if desired, be coated on the surface with a surface coating. Appropriate processes and surface coatings are known per se to a person skilled in the art. The non-grain-oriented electrical steel strip or sheet obtained after step (C) can advantageously be used in electric machines.

The present invention preferably provides the process of the invention, wherein the following step (D):

(D) Reference heat treatment of the non-grain-oriented electrical steel strip from step (C) at a temperature of from 600 to 1000° C.

is carried out after step (C).

Step (D) of the process of the invention ("reference heat treatment") is carried out when an electrical steel strip or sheet according to the invention which has particularly advantageous magnetic properties and can again preferably be used as stator in an electric machine is to be obtained. Step (D) of the process of the invention is preferably carried out on components which have been parted from the non-grain-oriented electrical steel strip which is obtained in step (C). Parts which are to be used as stator in electric machines are preferably separated by stamping or cutting from the non-grain-oriented electrical steel strip obtained in step (C). Methods for doing this are known per se to a person skilled in the art, for example stamping, laser beam cutting, water jet cutting, wire erosion. The optional step (D) of the process of the invention can, according to the invention, be carried out on the components themselves, but it is also possible according to the invention for the individual components to be assembled to give packets and then treated in step (D).

The optional step (D) of the process of the invention comprises heat treatment at a temperature of from 600 to 1000° C., preferably from 700 to 900° C., particularly preferably from 750 to 850° C. According to the invention, the temperatures mentioned can fluctuate by up to 20° C. upward and by up to 15° C. downward during step (C).

In the optional step (D) of the process of the invention, the heating rate is preferably at least 100° C./h. The hold time at the final temperature in this step is, according to the invention, preferably at least 20 minutes.

In general, the optional step (D) can be carried out in all ways known to a person skilled in the art. According to the invention, step (D) is preferably carried out in a static furnace plant. It is likewise possible to carry out step (D) in a continuous heat treatment process, which is known per se to a person skilled in the art.

The present invention also provides a component for electrical applications, produced from an electrical steel strip or sheet according to the invention, preferably having a theoretical density of from 7.55 to 7.67 kg/cm$^3$. Examples of components for electrical applications are electric motors, generators or transformers, in particular rotors or stators which preferably represent basic components of an electric machine by means of which energy conversion can be carried out, in particular electric energy into mechanical energy or mechanical energy into electric energy.

The present invention further provides for the use of an electrical steel strip or sheet according to the invention in components for electrical applications, in particular in electric motors, generators or transformers, in particular rotors or stators which preferably represent basic components of an electric machine by means of which energy conversion can be carried out, in particular electric energy into mechanical energy or mechanical energy into electric energy.

EXAMPLES

The invention will be illustrated below with the aid of working examples.

Silicon steels having the compositions shown in Table 1 are used as base material.

TABLE 1

| | Sample 1 | Sample 2 | Sample 3 |
|---|---|---|---|
| C | 0.0016 | 0.0017 | 0.0019 |
| Mn | 0.165 | 0.17 | 0.167 |
| P | 0.01 | 0.015 | 0.011 |
| S | 0.0011 | 0.0013 | 0.0011 |
| Si | 2.36 | 2.38 | 2.37 |
| Al | 0.335 | 0.376 | 0.368 |
| N | 0.004 | 0.002 | 0.002 |
| Ti | 0.002 | 0.001 | 0.002 |

All amounts reported in % by weight, balance to 100% by weight Fe and unavoidable impurities Hot-rolled strips are produced from these steels. The hot rolling temperature here is 830° C. After reel-up of the hot-rolled strip at 620° C., cold rolling to a thickness of 2.4 mm is carried out. The values of $P_{1.0/50}$, $P_{1.5/50}$, $J_{2500/50}$, $P_{1.0/400}$, Rp0.2 and Rm are subsequently determined. The values are shown in Table 2.

TABLE 2

| | | $P_{1.0/50}$ [W/kg] | A | $P_{1.5/50}$ [W/kg] | A | $J_{2500/50}$ [T] | A | $P_{1.0/400}$ [W/kg] | A | Rp0.2 [N/mm$^2$] | A | Rm [N/mm$^2$] | A |
|---|---|---|---|---|---|---|---|---|---|---|---|---|---|
| Sample 1 | finally heat treated | 1.69 | — | 3.65 | — | 1.61 | — | 22.99 | — | 360 | — | 499 | — |
| | reference heat treated at 800° C. | 1.0 | 1.69 | 2.65 | 1.38 | 1.58 | 1.02 | 19.46 | 1.18 | 293 | 1.23 | 452 | 1.10 |
| | reference heat treated at 850° C. | 0.96 | 1.76 | 2.64 | 1.38 | 1.57 | 1.03 | 19.71 | 1.17 | 287 | 1.25 | 443 | 1.13 |
| Sample 2 | finally heat treated | 1.87 | — | 3.97 | — | 1.61 | — | 24.05 | — | 357 | — | 485 | — |
| | reference heat treated at 790° C. | 0.97 | 1.93 | 2.53 | 1.60 | 1.60 | 1.01 | 19.24 | 1.25 | 293 | 1.22 | 441 | 1.10 |
| | reference heat treated at 850° C. | 0.91 | 2.05 | 2.47 | 1.61 | 1.59 | 1.01 | 19.11 | 1.26 | 287 | 1.24 | 432 | 1.02 |
| Sample 3 | finally heat treated | 1.24 | — | 2.76 | — | 1.59 | — | 20.37 | — | 319 | — | 468 | — |
| | reference heat treated at 770° C. | 0.93 | 1.33 | 2.33 | 1.18 | 1.59 | 1.00 | 17.80 | 1.14 | 292 | 1.09 | 437 | 1.07 |
| | reference heat treated at 850° C. | 0.89 | 1.39 | 2.30 | 1.20 | 1.58 | 1.01 | 17.90 | 1.14 | 287 | 1.11 | 426 | 1.10 |

A Ratio of the corresponding values for finally heat treated/reference heat treated The measured values reported were determined by the following methods:

Rp0.2:

The value Rp0.2 describes the yield point of the material and is determined in accordance with DIN EN ISO 6892-1: 2017-02 "Metallic materials—Tensile testing—Part 1: Method of test at room temperature".

Rm:

The value Rm describes the tensile strength of the material and is determined in accordance with DIN EN ISO 6892-1: 2017-02 "Metallic materials—Tensile testing—Part 1: Method of test at room temperature".

Polarization:

The polarization is determined in accordance with DIN EN 60404-2: 2009-01 "Magnetic materials—Part 2: Methods of measurement of the magnetic properties of electrical steel strip and sheet by means of an Epstein frame".

Losses P:

The loss P is determined in accordance with DIN EN 60404-2: 2009-01 "Magnetic materials—Part 2: Methods of measurement of the magnetic properties of electrical steel strip and sheet by means of an Epstein frame".

INDUSTRIAL APPLICABILITY

The non-grain-oriented electrical steel strip or sheet of the invention can preferably be used in electric motors, in particular for use in electric vehicles, or in generators.

The invention claimed is:

1. A process for producing a non-grain-oriented electrical steel strip or sheet, comprising:

(A) Providing a hot-rolled strip containing, apart from iron and unavoidable impurities in % by weight:
up to 0.0040 of C,
from 0.1500 to 0.3000 of Mn,
from 2.300 to 2.700 of Si,
from 0.3000 to 0.8000 of Al,
up to 0.0400 of P,
up to 0.0035 of S,
up to 0.0070 of N and
up to 0.0070 of Ti, (B) Cold rolling of the hot-rolled strip to give a cold-rolled strip;

(C) Final heat treating of the cold-rolled strip from step (B) at a temperature of from 750 to 950° C. to give the non-grain-oriented electrical steel strip or sheet;

(D) Subsequent to the final heat treating, cooling the non-grain-oriented electrical strip or sheet to ambient temperature;

(E) Subsequent to the cooling from step (D), reference heat treating of the non-grain-oriented electrical steel strip or sheet at a temperature of from 600 to 1000° C.; and subsequent to the final heat treating of step (C) and prior to the reference heat treating of step (E), performing a parting process including selected from one of cutting, stamping and laser cutting on the non-grain-oriented electrical strip or sheet, wherein the reference heat treating of step (E) repairs damage arising at parting edges on the non-grain-oriented electrical strip or sheet resulting from the parting process;

wherein a yield point $Rp_{0.2}$ in the non-grain-oriented electrical steel strip or sheet subsequent to step (E) is 300 to 399 N/mm$^2$;

wherein a ratio of magnetic loss $P_{1.0/50}$ of the non-grain-oriented electrical strip or sheet subsequent to the final heat treating of step (C) to magnetic loss $P_{1.0/50}$ of the non-grain-oriented electrical strip or sheet subsequent to the reference heat treating of step (E) is at least 1.30.

2. A process for producing a non-grain-oriented electrical steel strip or sheet, comprising:

(A) Providing a hot-rolled strip containing, apart from iron and unavoidable impurities in % by weight:
up to 0.0040 of C,
from 0.1500 to 0.3000 of Mn,
from 2.300 to 2.700 of Si,
from 0.3000 to 0.8000 of Al,
up to 0.0400 of P,
up to 0.0035 of S,
up to 0.0070 of N and
up to 0.0070 of Ti, (B) Cold rolling of the hot-rolled strip to give a cold-rolled strip;

(C) Final heat treating of the cold-rolled strip from step (B) at a temperature of from 750 to 950° C. to give the non-grain-oriented electrical steel strip or sheet;

(D) Subsequent to the final heat treating, cooling the non-grain-oriented electrical strip or sheet to ambient temperature;

(E) Subsequent to the final heat treating, performing a parting process selected from one of cutting, stamping and laser cutting on the non-grain-oriented electrical strip or sheet;

(F) Using first portions of the non-grain-oriented electrical steel strip or sheet as a rotor in a first electric machine;

(G) Reference heat treating of remaining second portions of the non-grain-oriented electrical steel strip or sheet at a temperature of from 600 to 1000° C. wherein the reference heat treating repairs damage arising at parting edges on the non-grain-oriented electrical strip or sheet resulting from the parting process, wherein the reference heat treating of step (G) repairs damage arising at parting edges from step (E) on the non-grain-oriented electrical strip or sheet resulting from the parting process; and (H) Using the second portions of the non-grain-oriented electrical steel strip or sheet as a stator in one of the first electric machine and a second electric machine;

wherein the reference heat treated remaining second portions of the non-grain-oriented electrical steel strip or sheet has a yield point $Rp_{0.2}$ of 300 to 399 $N/mm^2$;

wherein a ratio of magnetic loss $P_{1.0/50}$ of the non-grain-oriented electrical strip or sheet subsequent to the final heat treating of step (C) to magnetic loss $P_{1.0/50}$ of the non-grain-oriented electrical strip or sheet subsequent to the reference heat treating of step (G) is at least 1.30.

3. The process of claim 1 wherein the non-grain-oriented steel strip or sheet has a thickness of from 0.26 to 0.38 mm.

4. The process of claim 1 wherein subsequent to the reference heat treating, the non-grain-oriented electrical steel strip or sheet has a grain size of from 50 to 130 μm.

5. The process of claim 1 wherein a ratio of magnetic loss $P_{1.5/50}$ in the non-grain-oriented electrical steel strip or sheet subsequent to the final heat treating to magnetic loss $P_{1.5/50}$ and subsequent to the reference heat treating is at least 1.10.

6. The process of claim 1, wherein a ratio of magnetic loss $P_{1.0/400}$ in the non-grain-oriented electrical steel strip or sheet subsequent to the final heat treating to magnetic loss $P_{1.0/400}$ and subsequent to the reference heat treating is at least 1.10.

7. The process of claim 1, wherein a ratio of polarization $J_{2500/50}$ in the non-grain-oriented electrical steel strip or sheet subsequent to the final heat treating to polarization $J_{2500/50}$ and subsequent to the reference heat treating is at least 1.01.

8. The process of claim 1 wherein a tensile strength $R_m$ in the non-grain-oriented electrical steel strip or sheet subsequent to step (C) and before step (E) is from 480 to 600 $N/mm^2$, and subsequent to step (E) is from 400 to 520 $N/mm^2$.

9. The process of claim 1 wherein the reference heat treating comprises heating the non-grain-oriented electrical strip or sheet at a rate of at least 100° C./hr.

* * * * *